US010518530B2

(12) United States Patent
Gracia Verdugo et al.

(10) Patent No.: US 10,518,530 B2
(45) Date of Patent: Dec. 31, 2019

(54) TESTING FOR WIPING PRE-TREATMENT OF PRINT MEDIA

(71) Applicant: Hewlett-Packard Development Company, L.P., Houston, TX (US)

(72) Inventors: Antonio Gracia Verdugo, Sant Cugat del Valles (ES); Mauricio Seras Franzoso, Sant Cugat del Valles (ES); Pau Costal, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/098,003

(22) PCT Filed: Jul. 18, 2016

(86) PCT No.: PCT/US2016/042841

§ 371 (c)(1),
(2) Date: Oct. 31, 2018

(87) PCT Pub. No.: WO2018/017048

PCT Pub. Date: Jan. 25, 2018

(65) Prior Publication Data

US 2019/0143679 A1 May 16, 2019

(51) Int. Cl.
*B41J 2/12* (2006.01)
*B41J 2/045* (2006.01)
(Continued)

(52) U.S. Cl.
CPC ..... *B41J 2/12* (2013.01); *B41J 2/04558* (2013.01); *B41J 2/125* (2013.01); *B41J 11/0015* (2013.01); *B41J 29/38* (2013.01)

(58) Field of Classification Search
CPC ... B41J 2/04558; B41J 11/0015; B41J 29/393
See application file for complete search history.

(56) References Cited

U.S. PATENT DOCUMENTS 5,929,888 A 7/1999 Kawamura
2003/0110413 A1 12/2003 Bernklau-Halvor
(Continued)

FOREIGN PATENT DOCUMENTS

CN 101858897 10/2010
CN 1021288882 7/2011
(Continued)

OTHER PUBLICATIONS

Rosenfield, B., "Mind Your Banners", Apr. 20, 2005, Screen Web, 7 pages.
(Continued)

*Primary Examiner* — Julian D Huffman
(74) *Attorney, Agent, or Firm* — HP Inc. Patent Department

(57) ABSTRACT

There is disclosed a non-transitory machine-readable medium encoded with instructions executable by a processor and comprising instructions to: control print apparatus to print a test pattern 11 on a test region of a print medium 4; receive test data relating to the test pattern 11 printed on the print medium 4 from a sensor 8; analyse the test data with reference to baseline data to determine if the test pattern 11 satisfies a print quality criterion; output an instruction to operate the print apparatus in a first mode, in which a pre-printing treatment is not applied to the print medium, in response to determining that the test pattern 11 satisfies the print quality criterion, the pre-printing treatment comprising wiping a printing surface of the print medium with a wiper element 10, 20; and output an instruction to operate the print apparatus in a second mode, in which the pre-printing treatment is applied to the print medium 4, in response to determining that the test pattern 11 satisfies the print quality criterion.

15 Claims, 8 Drawing Sheets

(51) Int. Cl.

| | |
|---|---|
| ***B41J 2/125*** | (2006.01) |
| ***B41J 11/00*** | (2006.01) |
| ***B41J 29/38*** | (2006.01) |

(56) References Cited

U.S. PATENT DOCUMENTS

| | | | | |
|---|---|---|---|---|
| 2011/0036255 | A1 | 2/2011 | Monclus | |
| 2012/0092701 | A1 | 4/2012 | Wang et al. | |
| 2014/0168307 | A1* | 6/2014 | Silveston-Keith | B41J 11/009 347/16 |

FOREIGN PATENT DOCUMENTS

| | | |
|---|---|---|
| CN | 103308640 | 9/2013 |
| CN | 103760253 | 4/2014 |
| EP | 20627341 | 5/2009 |

OTHER PUBLICATIONS

Unknown, "Getting the Best Results with PVC Banners on the HP Latex 3000", Jan. 17, 2014, HP, 8 pages.

* cited by examiner

TESTING FOR WIPING PRE-TREATMENT OF PRINT MEDIA

Some printing media may contain substances which over time may migrate to the printing surface. This phenomenon may occur for instance when rolled media is exposed to high temperatures, for example, during transportation or storage, or simply when media is stored for some time before use.

For example, print media such as vinyl and PVC banners may contain plasticizers to increase their flexibility, and these additives may tend to migrate to the surface. Other substances that may exhibit a tendency to migrate to the printing surface may be, for example, adhesives or silicones present in adhesive media.

Figure 1:
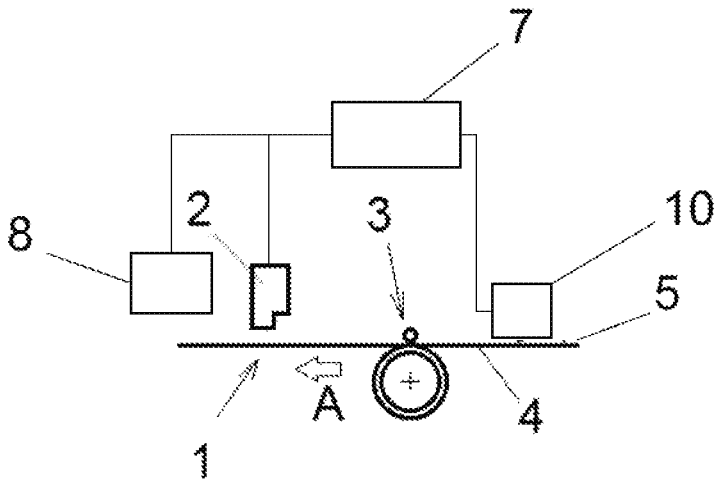
Figure 2:
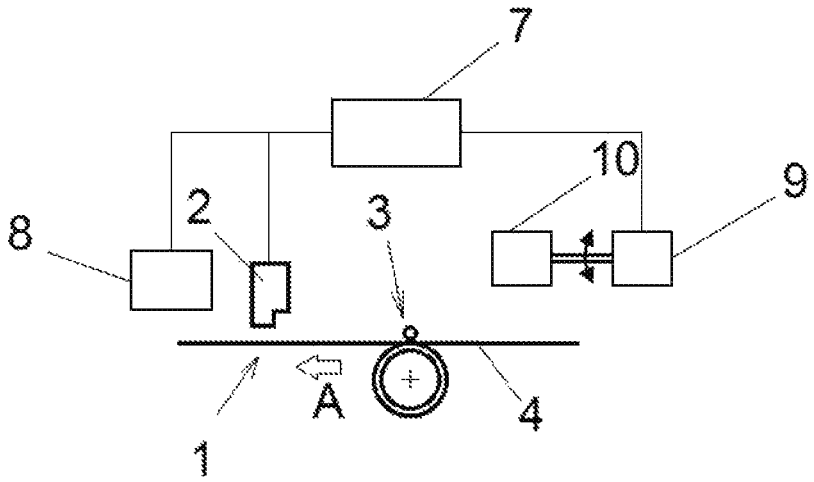
Figure 3:
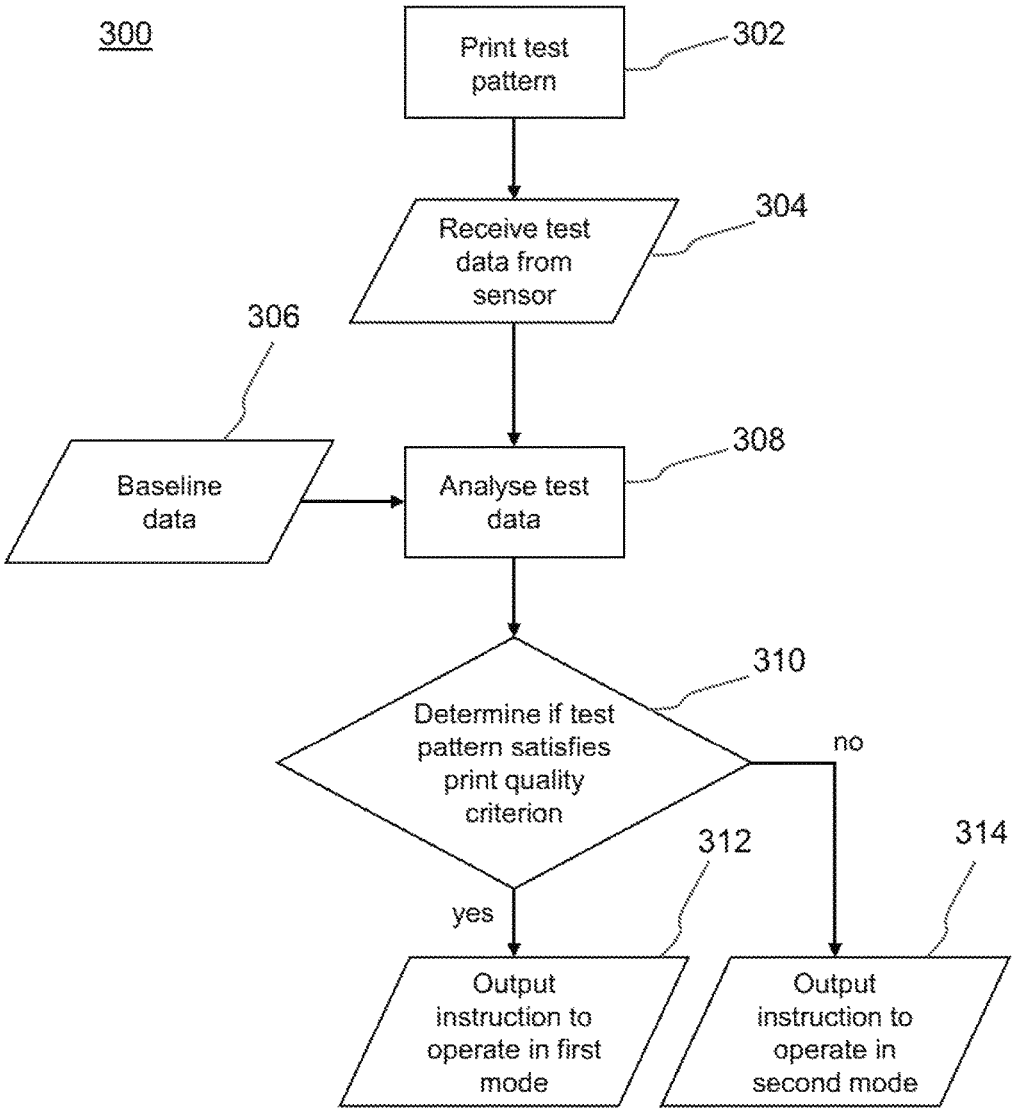
Figure 4:
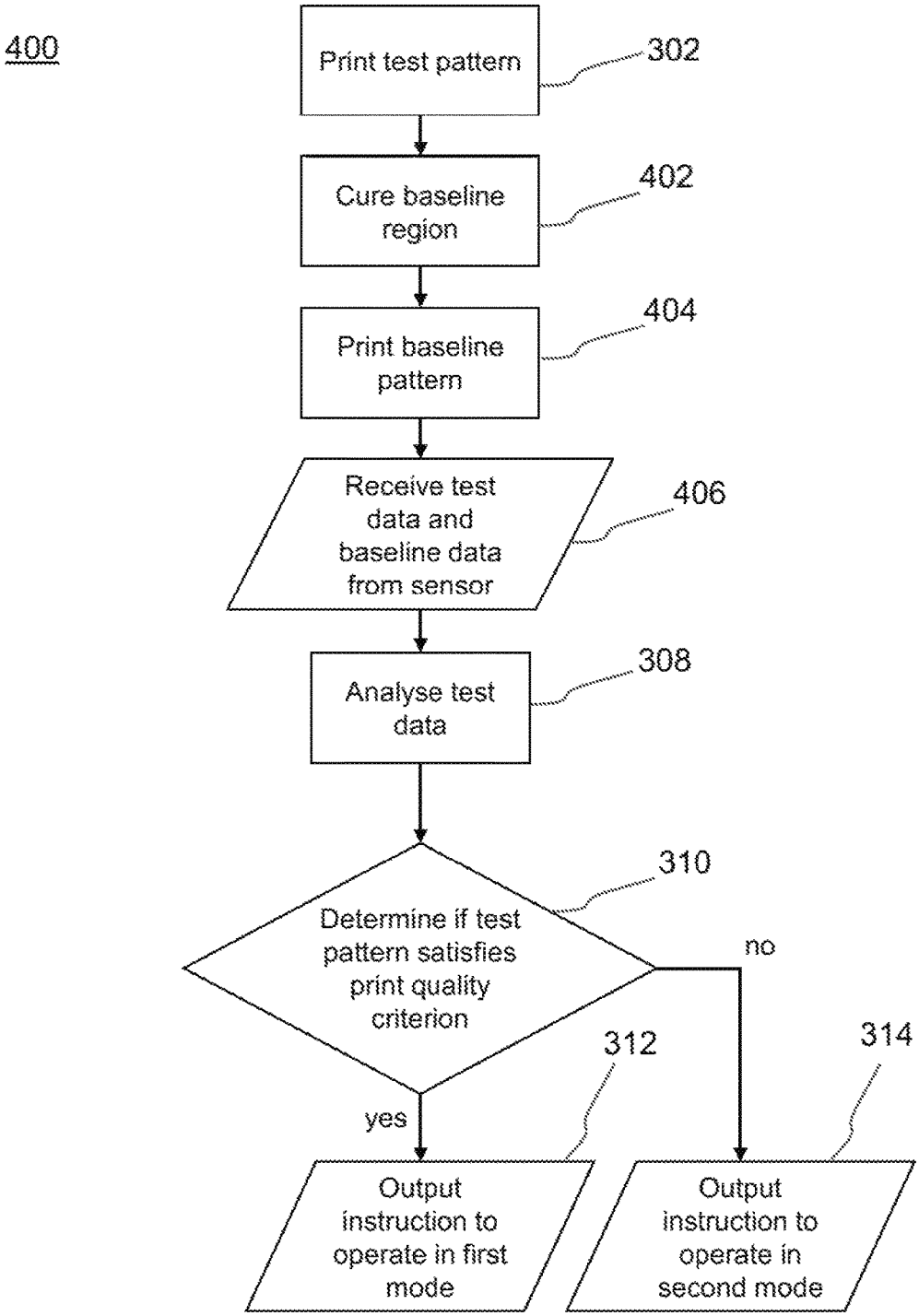
Figure 6:
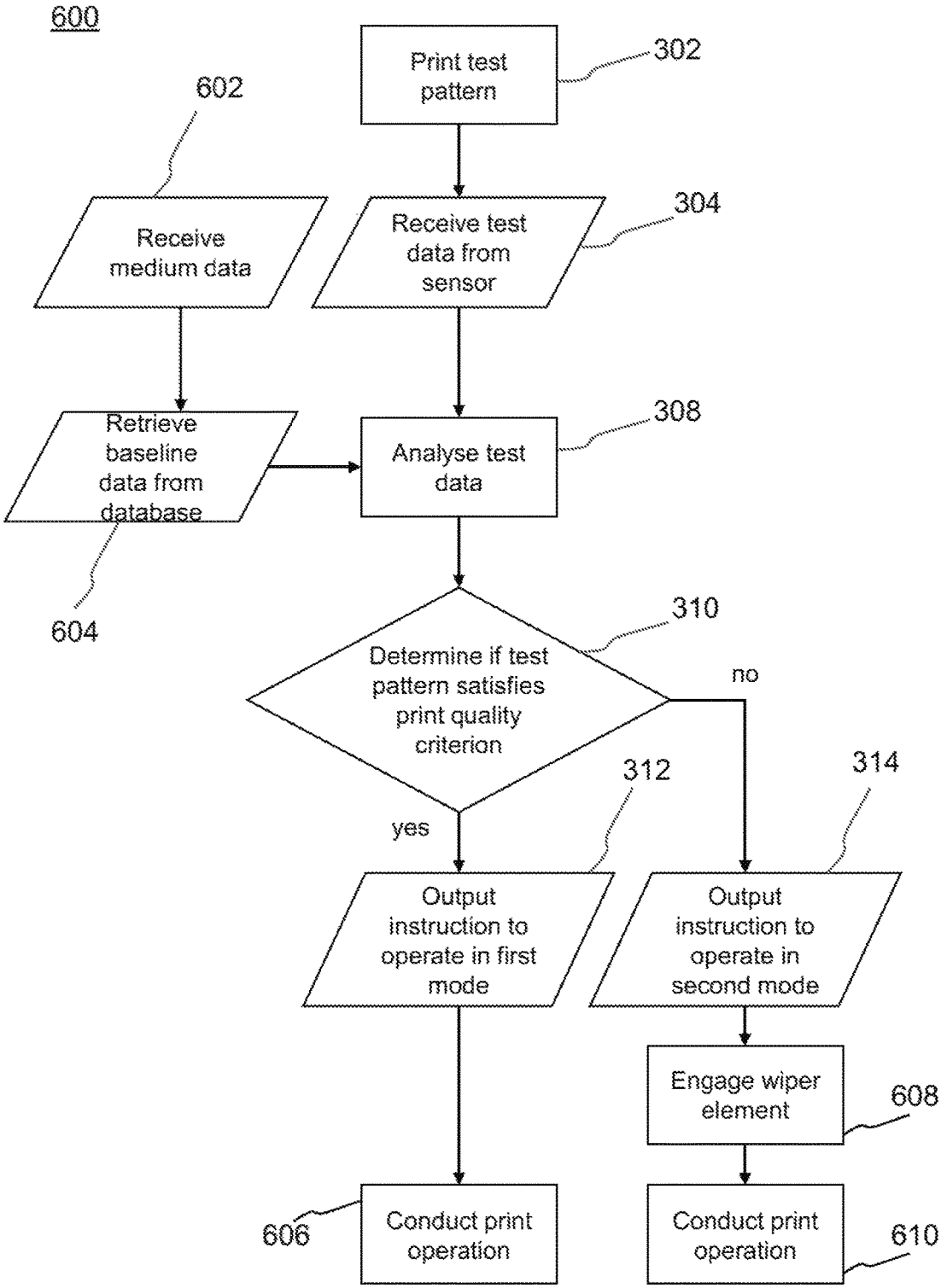
Figure 7:
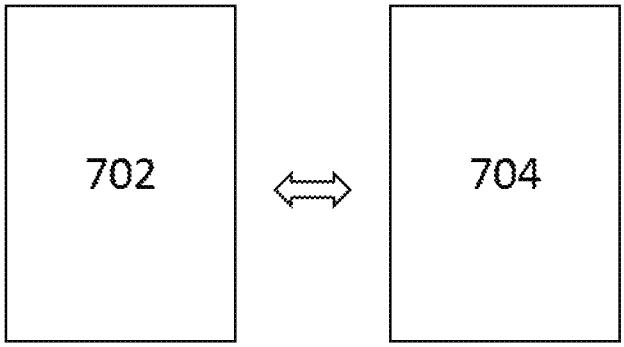
Figure 8:
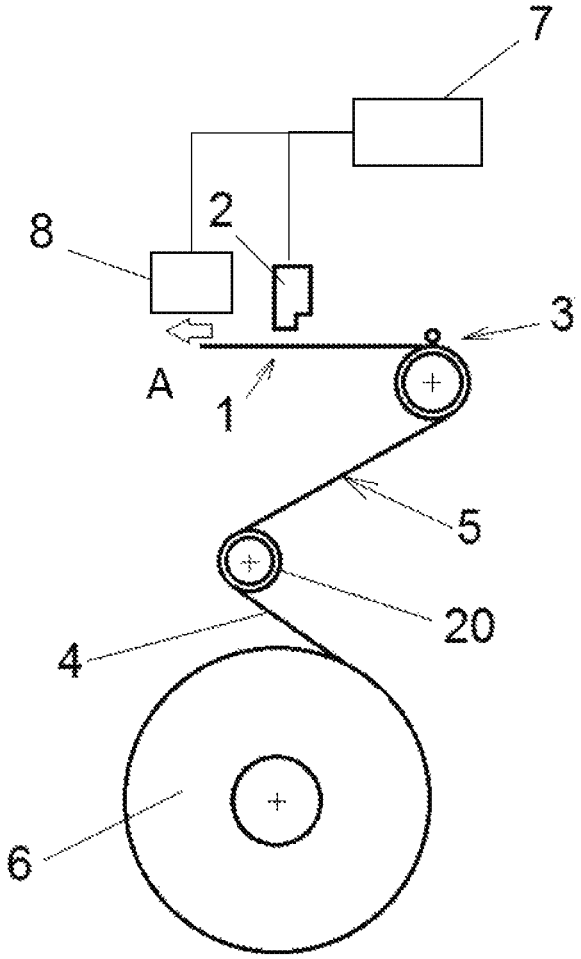
Figure 9A:
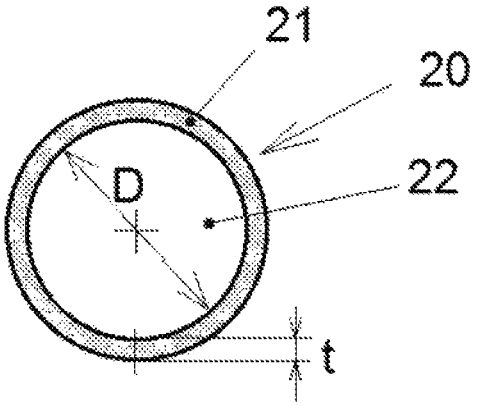
Figure 9B:
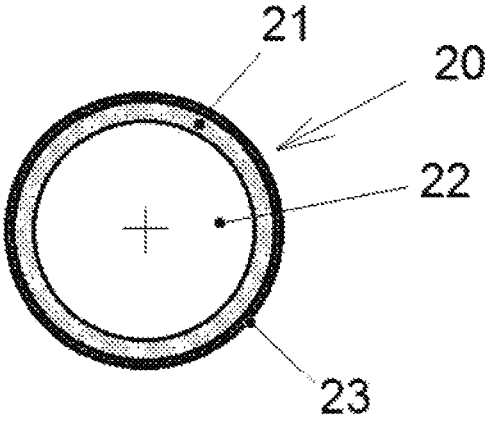
Figure 10:
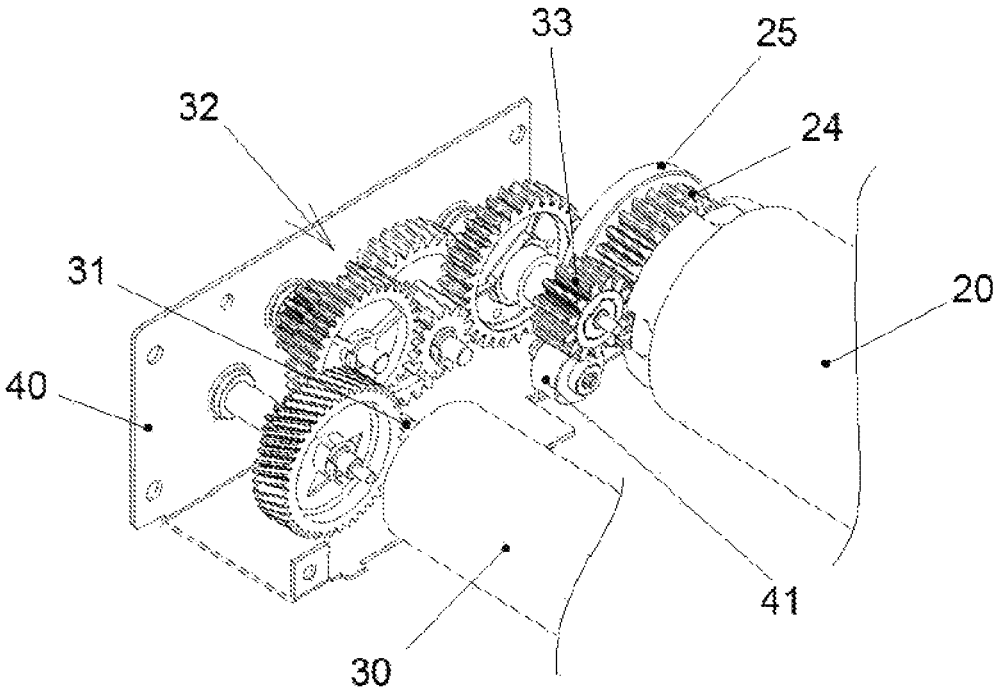
Figure 11:
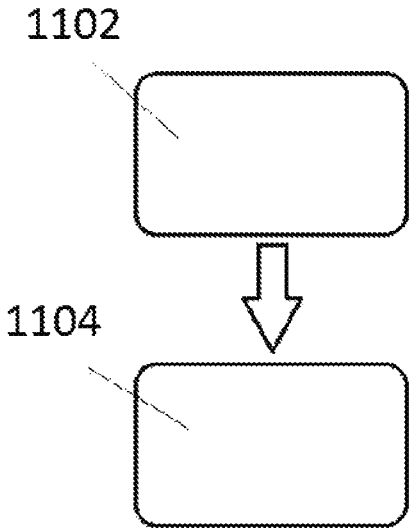

Some non-limiting examples of the present disclosure will be described in the following with reference to the appended drawings, in which:

FIGS. 1 and 2 schematically show examples of print apparatus;

FIGS. 3 and 4 are flowcharts illustrating example testing methods;

FIGS. 5A-5D schematically show example test and baseline print patterns on a print medium;

FIG. 6 is a flowchart illustrating an example method of testing and operating a print apparatus;

FIG. 7 schematically shows a machine readable medium and a processor;

FIG. 8 illustrates a further example print apparatus;

FIGS. 9*a* and 9*b* are schematic section views illustrating examples of wiping rollers;

FIG. 10 is a schematic perspective view showing examples of the mounting of a wiping roller in apparatus as disclosed herein; and FIG. 11 is a flowchart illustrating examples of a method for printing.

The presence in some printing media of substances, such as plasticizers or adhesives, which over time may migrate to the printing surface forming micro-droplets or random patterns, may affect the quality of printed images.

A substance that has migrated to the printing surface, and/or contaminants present in the form of droplets, micro-droplets or moisture on the surface, may create differences in the surface tension, and it may therefore happen that printing fluid does not deposit uniformly. When printing on such a medium, for example with latex printing fluids, defects such as for example graininess, pinholes or coalescence may appear in the printed image.

In implementations disclosed herein the printing quality may be improved by wiping the printing surface of the media before printing, so as to spread over a larger surface area, i.e. more evenly, substances that may be present on the surface in the form of micro-droplets or the like.

Examples of a print apparatus as disclosed herein are illustrated in FIG. 1. Example apparatus may comprise a print zone 1 where a printing fluid may be deposited on the printing surface 5 of a print medium 4 from a printhead 2. Input rollers 3 may cause the advance of the print medium 4 towards the print zone 1, in a direction of print media advance shown by arrow A in FIG. 1.

According to examples disclosed herein, a wiping element 10 may be provided in the apparatus before the print zone 1, i.e. upstream of the print zone, in the direction of print media advance A through the apparatus, so that it slips in contact with the print medium 4 when the print medium is advanced towards the print zone 1, thereby wiping the printing surface 5 of the print medium 4 before printing.

By "slip" or "slipping" it is meant herein that the wiping element is in contact with the printing surface of the print medium, and has a different speed from that of the printing surface in the area of contact, such that during operation there is a non-zero relative speed between the wiping element and the printing surface. In other words, there is relative sliding movement between the wiping element and the printing surface whilst they are in contact. The relative speed may be caused for example by the wiping element having a higher speed than that of the print medium, or by the wiping element being stationary or having a lower speed than that of the print medium.

The friction caused by wiping may have the effect that substances such as plasticizers that may be present on the printing surface in a non-continuous or uneven distribution, for example in the form of micro-droplets, clots, lumps, or other irregularities, are spread or distributed more evenly. For example, a droplet would be "flattened" on the media and spread over a larger area.

This allows reducing the differences in surface tension between different areas of the print medium and reducing potential defects in the printed image that may be associated with these differences. The quality of the printed image may therefore be improved.

The effect on the printed image of other contaminants present on the surface of the media, for example small amounts of grease from fingerprints due to media handling, may also be reduced.

As shown in FIG. 1 an example print apparatus may further comprise a sensor 8 for monitoring a printed region of the print surface 5 of the print medium 4. In this example, the sensor 8 is disposed downstream of the printhead 2. In this example, the sensor 8 comprises a spectrophotometer to monitor color properties of a pattern printed on the print medium. In other examples, other sensors could be used, for example an optical sensor and more particularly a line sensor.

The sensor is to monitor properties of a pattern printed on the print medium related to print quality, in particular properties which are affected by substances such as plasticizers when migrated to the printing surface 5 of the print medium.

For example, one such property is the coalescence of print agent droplets (such as ink droplets), which may be excessive when such substances are migrated to the printing surface. Color may be affected by coalescence, in particular because droplets may coalesce in an unintended manner and therefore result in a different color than intended. A spectrophotometer is to monitor color properties of a printed pattern (or a portion of a printed pattern) so that a color difference between the pattern and a baseline pattern may be determined, either by the spectrophotometer or by a separate controller.

Coalescence may also affect the geometric accuracy of a print pattern, as can be measured by a line sensor. In particular, coalescence may adversely affect the geometric definition of a line or border of a printed portion of the print pattern. For example, a gap between two adjacent printed regions of a pattern may be reduced relative a baseline pattern owing to coalescence effects, for example the gap may be reduced by an amount between 0.01 mm to 0.1 mm. A line sensor may be used to determine the dimension of the gap as compared to a corresponding dimension in a baseline pattern to determine the difference.

As shown in FIG. 1, the print apparatus further comprises a controller 7. In this example, the controller 7 is to control the printhead 2 and the sensor 8. In other examples, there may be separate controllers for these components.

The controller 7 is to control the operation of the printhead 2 to selectively eject a print agent onto the print medium (i.e. to print), based on a print job instruction. For example, the controller 7 may control the printhead 2 to print a test pattern on the print medium, as will be described in detail below.

The controller 7 is to receive an output from the sensor 8 relating to a pattern printed on the print medium. In this particular example, the controller 7 is to control the sensor 8 to monitor a particular portion of a pattern, in particular a test pattern printed on the printed medium, and is to receive test data relating to the test pattern from the sensor 8. In this particular example, the sensor 8 is a spectrophotometer, and the controller 7 is to receive test data relating to the color of a portion of a test pattern, as will be described in detail below.

Further, the controller is to analyse the test data with reference to baseline data, as will be described in detail below.

FIG. 2 shows a further example print apparatus which differs from that described above with respect to FIG. 1 in that the wiping element 10 is selectively moveable from a disengaged configuration (FIG. 2) to an engaged configuration (as shown in FIG. 1) upstream of the print zone with respect to a direction of print media advance through the print apparatus. In the disengaged configuration the wiping element 10 is spaced apart from the path of the print medium 4 so that in use it does not engage the printing surface of the print medium 4. For example, in example apparatus in which the printing surface 5 faces upward and the wiping element 10 is disposed over the print medium 4, as shown in FIGS. 1 and 2, the wiping element 10 may be suspended over and spaced apart from the printing surface (or a media advance path for the print medium) by a separation distance such as between 1 and 5 cm. In the engaged configuration the wiping element is to engage the printing surface 5 of the print medium 4 to wipe it (i.e. for relative sliding movement in contact with the printing surface), as described above. For example, in the apparatus of FIG. 2, the wiping element 10 moves downwardly from the disengaged configuration to the engaged configuration in which the wiping element 10 is in contact with the printing surface 5 of the print medium, or is aligned with a media advance path for the print medium to contact the printing surface 5 of a print medium to be conveyed past the wiping element 10. As shown in FIG. 2, the print apparatus further comprises an actuator 9 for moving the wiping element 10 between the disengaged and engaged configurations. In this example, the controller 7 is to control the actuator for moving the wiping element 10 between the disengaged and engaged configurations.

In this example, the actuator 9 is to move the wiping element 10 between the disengaged and engaged configurations by pivoting a pivotable element, however it will be appreciated that other arrangements may be used in other example print apparatus. For example, the wiping element may be mounted on a rail suspended over a media path for the print medium, and may be coupled to a linear actuator for driving the wiping element along the rail between a disengaged configuration and an engaged configuration.

An example method 300 of testing for wiping pre-treatment of print media will now be described with reference to the flowchart of FIG. 3 (i.e. testing to determine whether such pre-treatment is to be applied). For illustrative purposes, the method will be described with reference to the print apparatus described above with reference to FIG. 2. In this example, the print apparatus is loaded with a print medium comprising PVC containing additive plasticizer.

In block 302, the controller 7 initiates a print operation to print a test pattern on a test region of the printing surface 5 of the print medium, without pre-curing the test region. The controller 7 controls the sensor 8 to monitor the test region.

In this example, the controller 7 causes a test pattern to be printed comprising a calibration pattern including adjacent blocks of different colours. In some examples, the calibration pattern may include an arrangement of lines, such as may be used for printhead alignment operations.

The sensor 8 outputs test data relating to the pattern. In this particular example, the sensor 8 is a spectrophotometer to monitor color properties of the test pattern, and the controller 7 controls the sensor 8 to output test data relating to one or a plurality portions of the test pattern, which is received by the controller 7 in block 304.

In this example, the controller 7 retrieves pre-stored baseline data in block 306, in particular pre-stored data relating to the one or plurality of portions of a baseline pattern corresponding to the test pattern.

In block 308, the test data is analysed to compare the test pattern with the baseline pattern. In this particular example, the analysis is a color difference analysis using data relating to the one or plurality of portions of the test pattern. In particular, the color difference analysis is used to determine a color difference between the respective portions of the test pattern and the baseline pattern. Such color difference analysis may be conducted to determine a color difference in units of $\Delta E$.

In this particular example, the spectrophotometer 9 and controller 7 are to analyse a color difference in units of $\Delta E$ as determined by the Delta-E 2000 standard introduced by the CIE organisation (International Commission on Illumination).

In other examples, for example when the sensor 8 is an optical sensor, the controller may compare other properties of the test pattern and baseline pattern, for example geometric properties relating to the alignment and position of features in the respective pattern, such as a size of a gap between printed features, or a thickness of a line. For example, the print quality criterion may define an alignment tolerance between a position of a line within the test pattern and a baseline position for the line. For example a tolerance of between 0.01 mm to 0.1 mm may be defined, such as 0.05 mm.

In block 310, the controller determines, based on the analysis, whether the test pattern satisfies a pre-determined print quality criterion. In this particular example, the print quality criterion is set so that satisfactory print quality is determined when each of the color difference comparisons of the respective one or plurality of portions of the test pattern that are monitored result in a measured color difference of less than $4\Delta E$. In other examples the threshold $\Delta E$ may be different, for example $3\Delta E$ or $5\Delta E$, or a different standard or unit may be used.

In block 312, in response to determining that the print quality criterion is satisfied, the controller 7 outputs an instruction to operate the print apparatus in a first mode in which a wiping pre-treatment is not applied to the print medium.

Conversely, in block 314, in response to determining that the print quality criterion is not satisfied, the controller 7 outputs an instruction to operate the print apparatus in a second mode in which a wiping pre-treatment is applied to the print medium.

In this particular example, the instruction to operate the print apparatus in the first mode is issued in the form of a controller setting for operation of the print apparatus (i.e. a parameter stored in a memory of the controller and retrieved in a subsequent print operation). In a subsequent print operation, the actuator 9 causes the wiping element 10 to move to or remain in the disengaged configuration. Similarly, in this particular example the instruction to operate the print apparatus in the second mode is issued in the form of a controller setting for the print apparatus, based on which in use the actuator 9 causes the wiping element 10 to move to or remain in the engaged configuration. In other examples, the instruction to operate the print apparatus in the first mode or second mode may result in the actuator 9 causing the wiping element 10 to move to or remain in the disengaged configuration or engaged configuration respectively in anticipation of a subsequent print operation.

In yet further examples, the instruction to operate the print apparatus in the first or the second mode may take different forms. In particular, where a print apparatus does not include a mechanism for actuating a wiping element to move between a disengaged configuration and an engaged configuration, the instruction to operate the print apparatus in the second mode may comprise a visual or audible instruction issued to an operator to manually install such a wiping element or wiping element assembly, such as the removable wiping element assembly as will be described below with respect to FIGS. 8-10. For example, a visible instruction may be issued via a display of the print apparatus. In some examples, the visible instruction may include technical or advisory information regarding the color difference or other monitored property. For example, when there is a low color difference (e.g. 1ΔE or 2ΔE) a notification may be displayed that no wiping pre-treatment is to be conducted. For an intermediate color difference (e.g. 3ΔE or 4ΔE), a notification may be displayed that a wiping pre-treatment may improve print quality so that a user or operator can elect whether to apply the wiping pre-treatment. For a high color difference (e.g. more than 4ΔE), a notification may be displayed that wiping pre-treatment should be applied to prevent poor print quality.

A further example method 400 of testing for wiping pre-treatment of a print medium will now be described with reference to FIGS. 4 and 5.

The further example method 400 differs from the method 300 described above with respect to FIG. 3 with regards to the generation of baseline data.

Figure 5A:
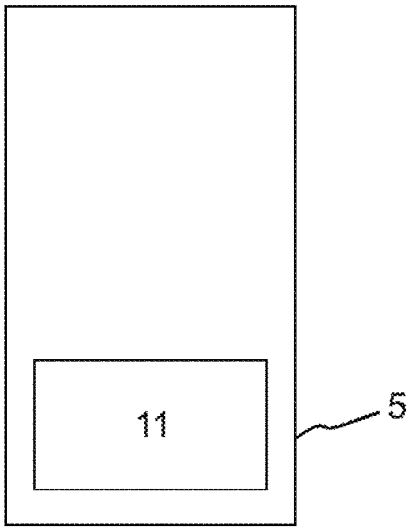

In block 302, the test pattern is printed on the printing surface 5 of the print medium 4 as described above. FIG. 5A shows the test pattern 11 printed on a test region of the printing surface 5.

Figure 5B:
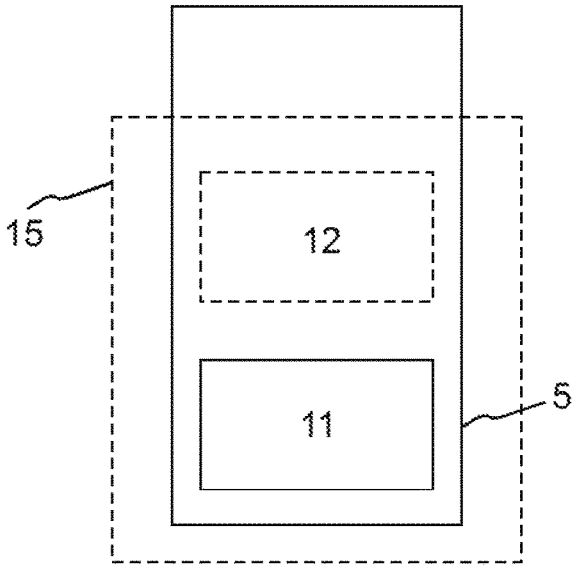

Printing may include curing print agent after ejection of the print agent onto a print medium, for example by applying radiative or convective heat to the printing surface. In block 402, curing of the test pattern 11 is extended over an extended area 15 (i.e. extended beyond the test pattern 11, as shown in FIG. 5B) covering both the test pattern 11 and an un-printed baseline region 12 of the printing surface 5 of the print medium 4. Curing the un-printed region adjacent the test pattern 11 can cause plasticizer and other substances which have migrated to the printing surface 5 to at least partially evaporate in this region, thereby mitigating against adverse effects of plasticizer. In other examples, post-printing curing of the test pattern 11, and pre-printing curing of the baseline region 12 may be conducted separately.

Figure 5C:
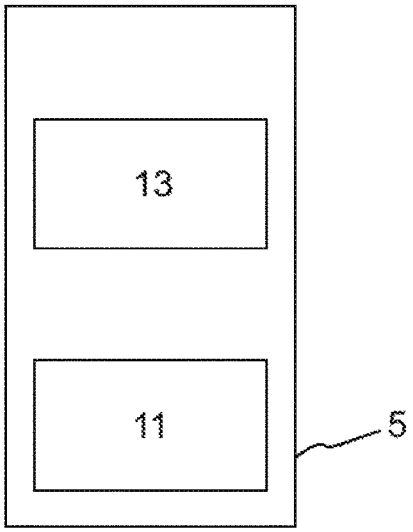
Figure 5D:
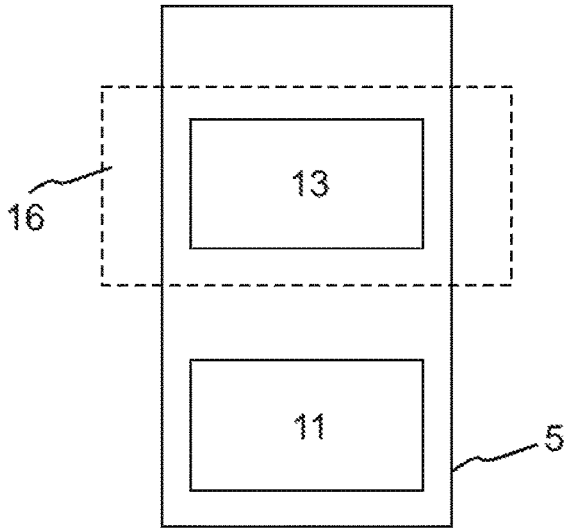

In block 404, a baseline pattern 13 (as shown in FIG. 5C) corresponding to the test pattern is printed on the baseline region 12 of the printing surface which was previously cured (in block 402). As described above, post-printing curing of the baseline pattern 13 follows printing (as shown in FIG. 5D, which shows a post-printing curing region 16 over the baseline region 12). In this particular example, the print apparatus comprises a convective heater extending over the width of the print medium, and the print apparatus is to move the print medium 4 relative the heater so that the respective regions 11, 12, 15 of the print medium 4 are cured as described above. In particular, the print apparatus is configured so that portions of the print medium 4 heated by the heater during curing reach a temperature of between 100° C. and 120° C.

In block 406, test data and baseline data are received at the controller 7 from the sensor 8 based on the sensor 8 monitoring the test pattern 11 and the printed baseline pattern 13 respectively.

In blocks 310, 312 and 314 the method proceeds as described above with respect to the method 300 of FIG. 3 to analyse the test data, determine whether the test pattern meets the print quality criteria, and issue an instruction to operate the print apparatus in the first mode or the second mode accordingly. The applicant has found that printing a baseline pattern 13 may eliminate printing artefacts and effects that are not caused by the presence of plasticizer and other substances migrated to the surface of a print medium. In particular, it will be appreciated that the baseline pattern is printed under the same conditions as the test pattern, except that the baseline pattern is printed on a pre-cured portion of the print medium.

FIG. 6 shows a further example method 600 of testing for a wiping pre-treatment and conducting a print operation.

The method 600 differs from the method 300 described above with respect to FIG. 3 in that the baseline data is retrieved from a database. In particular, the test pattern is printed (block 302) and the test data is received (block 304) as described above. According to the method 600, in block 602 medium data is received, for example from a user input identifying the type of print medium (e.g. the composition of the medium, the color of the printing surface of the print medium), or from a print job instruction containing medium data.

In block 604, the baseline data is retrieved from a database based on the medium data. In particular, in this example the database is stored in a memory, for example a memory of the controller 7 or of a remote system, and is correlated by medium data such as medium type and color. Accordingly, in block 604, the controller 7 looks up and retrieves pre-stored baseline data form the database based on the medium data.

In blocks 308, 310, 312, 314 the method 600 proceeds as described above with respect to the method 300 of FIG. 3. In particular, the test data is analysed with respect to the baseline data in block 308. In block 310 it is determined whether the test pattern satisfies a print quality criterion.

In block 312, an instruction is output to operate the print apparatus in the first mode in response to a determination that the test pattern satisfies the print quality criterion. In block 606, the controller 7 processes a print job received at the print apparatus with the print apparatus in the first mode of operation such that the wiping element 10 remains or is moved to the disengaged configuration. In other such examples where the wiping element 10 is not moveable by an actuator, a user or operator may be instructed to ensure that the wiping element is in a disengaged configuration or is not installed (for example by removing the wiping element or moving it to a disengaged configuration). In this example, the print job is received at the print apparatus prior to conducting the method 600, and the method 600 including both testing for the wiping pre-treatment and conducting the print operation is initiated in response to receiving the print job.

In response to a determination that the test pattern does not satisfy the print quality criterion, an instruction is output to operate the print apparatus in the second mode in block 314. As previously described, in this example the instruction is in the form of a print apparatus setting stored in a memory, for example a memory of the controller 7.

In block 608, the controller 7 proceeds to execute the print job and determines that the print apparatus setting for the wiping element 10 indicates that the wiping element 10 is to be applied. Accordingly, responsive to a determination by that the wiping element 10 is not currently engaged (for example by reference to an output of the actuator 9 or a control log for the actuator 9 stored in memory of the controller 7) the controller 7 causes the actuator 9 to move the wiping element 10 from the disengaged configuration to the engaged configuration.

In block 610, a print operation is conducted according to the print job such that as the print medium moves relative the wiping element 10, the wiping element 10 engages the printing surface 5 of the print medium 4. Accordingly, and as described above, plasticizer and other substances which may have migrated to the printing surface may be wiped, partially removed and/or redistributed to mitigate against the adverse printing artefacts of such substances.

The applicant has found that testing for a wiping pre-treatment, in particular by printing a test pattern and comparing to baseline data, enables the wiping pre-treatment to be applied when it is most effective. As a corollary, the wiping pre-treatment may not be applied when it is less effective, for example when printing defects or artefacts are unrelated to the presence of plasticizer or other substances that may have migrated to the surface of the print medium, or when there are no such printing defects. Testing for the wiping pre-treatment in this way may enable a service life of a wiping element to be maintained, and running costs to be reduced.

FIG. 7 shows a non-transitory machine-readable medium 702 encoded with instructions executable by a processor 704. In an example, the instructions include instructions to print a test pattern, receive test data from a sensor, analyse the test data with reference to baseline data, determine if the test pattern satisfies a print quality criterion based on the analysis, and to output an instruction to operate a print apparatus in either a first mode or a second mode accordingly as described above with respect to the method 300 depicted in the flowchart of FIG. 3.

FIG. 8 shows schematically examples of print apparatus also comprising a print zone 1, a printhead 2, input rollers 3 to cause the advance of a print medium 4 in a direction of print media advance A, a controller 7 and a sensor 8. The print medium 4 may be fed from a media roll 6.

In examples such as shown in FIG. 2, the wiping element may be a wiping roller 20 that is provided in the media advance path before the print zone 1 and slips in contact with the printing surface 5 of the print medium 4 to wipe it.

In some examples, the angle through which there is contact between the wiping roller 20 and the print medium 4 is between 10° and 120°.

A wiping roller may have a relatively small contact area with the print medium and still provide a wiping action. Consequently it may be fitted in the media advance path taking up a relatively small space and without affecting the apparatus footprint.

In some examples the back tension of the print medium 4 in the advance path provides a degree of pressure to apply the medium 4 against the wiping roller 20 and maintains the contact between medium and roller. In examples disclosed herein, the back tension may be between 20 and 40 N/m.

In some implementations of print apparatus as disclosed herein, such as illustrated in FIG. 9*a*, the wiping roller 20 comprises a layer of elastic material 21, for example, attached on a rigid tubular core 22.

The layer of elastic material 21 may be compressed when applied against the print medium, so it may allow maintaining the wiping roller 20 in contact with the printing surface 5 along all the width of the print medium 4 even if there is some degree of misalignment, and therefore may allow relatively uniform wiping, avoiding local defects.

In some examples, dimensions for a wiping roller 20 may be between 50 and 60 mm for the diameter D of the core 22, and between 4 and 10 mm for the thickness t of the layer of elastic material 21.

In some examples, such as illustrated in FIG. 9*b*, the wiping roller 20 comprises a sheath 23 of textile material covering the layer of elastic material 21. The sheath 23 may be made for example of polyester microfiber or suede.

The presence of a sheath 23 may improve the mechanical resistance of the wiping roller 20. Furthermore, maintenance may be simplified by the fact that once the wiping surface becomes affected by wear and/or by having plasticizer or similar substances adhered thereon, as a consequence of use, it is possible to substitute the sheath.

In some implementations of a wiping element such as a wiping roller, both with or without a sheath of textile material, the elastic material may be foam, or a soft rubber. In some examples it may be foam rubber, that is, rubber having an air-filled matrix structure obtained by using a foaming agent. For example, the layer of elastic material 21 may be of polyurethane (PU) foam rubber, which is also wear resistant and compatible with printing fluids.

In some examples of implementations disclosed herein, the maximum compressibility of the layer of elastic material, defined as the maximum compression the material may undergo while remaining elastic, is at least of 50%. With a 50% maximum compressibility, for example, a layer of elastic material with a thickness of 5 mm may undergo a deformation of up to 2.5 mm in a direction perpendicular to the contact surface, for adapting to misalignments of the print medium.

In some examples, implementations of print apparatus disclosed herein comprise a motor to drive the wiping roller in rotation. FIG. 10 for example shows examples in which a motor 30 with an output shaft 31 is mounted on the frame 40 of the apparatus. In some examples the motor may be for example a DC motor controlled with an encoder (not shown).

In some examples, such as shown in FIG. 10, the wiping roller 20 comprises a driving pinion 24 and the motor 30 drives the wiping roller 20 in rotation through a transmission 32 between the motor output shaft 31 and the driving pinion 24. In an example such as that of FIG. 10 the transmission 32 may be a gear transmission and may comprise a transmission pinion 33 intended to mesh with the driving pinion 24.

Also visible in FIG. 10 is that in some implementations of a print apparatus with a wiping roller as disclosed herein, the wiping roller 20 may be mounted on a pair of idle support rollers 41 (one visible in FIG. 10). The wiping roller 20 is provided with a cylinder section 25 for resting on the support rollers 41.

In implementations as disclosed herein, a wiping roller 20 for wiping the printing surface of a print medium, for example such as disclosed above in relation to FIGS. 9*a*, 9*b* and 10, may be provided as a kit, or as part of a kit, to be installed in a print apparatus. The kit may also comprise a driving motor, and may also comprise a transmission.

In some examples, such a wiping roller 20 may comprise as disclosed above a rigid core 22, a layer of elastic material 21 attached to an outer surface of the rigid core, and a driving pinion 24. In some examples it may also comprise a sheath 23 of textile material.

In some implementations it may be foreseen to install a wiping roller 20, for example having a layer of elastic material 21 and a driving pinion 24, in a print apparatus comprising a motor and transmission, in order to print on some kind of print media such as a vinyl banner, which contain substances that may migrate to the printing surface.

It may also be foreseen in some implementations to remove the wiping roller 20 from the print apparatus and change it with a plain roller that is not provided with a layer of elastic material or a driving pinion, for example in order to print on other kinds of print media, without prior wiping of the printing surface.

In examples according to some implementations of a print apparatus, the wiping element 10 may be stationary. For example, the wiping element 10 may comprise a wiping surface, flat or curved, against which the print media slips in order to be wiped.

The material of the wiping surface of a wiping element according to examples as disclosed herein may have a dynamic friction coefficient below 0.7 with respect to vinyl print media, in order to avoid affecting the accuracy of the print media advance.

Implementations of a method for printing are illustrated schematically by the flowchart of FIG. 11, and may comprise, in block 1102, spreading over a larger print medium area, by wiping, amounts of a substance that may migrate through a print medium and that is present on the printing surface of a print medium, before printing on the print medium in block 1104. The method for printing may correspond to the printing operation described above with respect to block 610 of FIG. 6.

In some examples, the wiping operation in block 1102 is performed with a wiping roller slipping in contact with the printing surface of the medium, such as examples of a wiping roller 20 as disclosed above. Slipping between the wiping roller and the print medium, and therefore wiping, may occur while the print medium is advancing, but also while it is stationary, for example when printing is performed in swaths on a print medium while stationary, and the print medium is advanced between swaths.

According to some implementations disclosed herein, in block 1102 the wiping roller may be rotated, for example employing a motor, in order to cause slipping of the wiping roller with respect to the print medium at least when the print medium is stationary. It may be rotated for example with an angular speed between 20 and 40 rpm.

In some implementations, example methods may involve rotating the wiping roller with an angular speed that causes the relative tangential speed of the surface of the wiping roller with respect to the printing surface of the print medium to be between about 2 in/s and about 5 in/s (between about 50.8 mm/s and about 127 mm/s), for example between about 3 in/s and about 4 in/s (between about 70.6 mm/s and about 101.6 mm/s).

During the wiping operation in block 1102, in some examples of the method a tension of the print medium maintains contact between the wiping roller and a printing surface of the print medium.

Some implementations of such methods may be performed by print apparatus as disclosed above.

In examples of printing operations in which implementations of this disclosure are put in practice, a wiping roller 20 such as shown in FIGS. 2 and 3*a* may be employed. Further features may be for example as follows:

- tubular steel core with an outer diameter D=50 mm
- PU foam rubber layer adhered on the steel core, thickness t=5 mm
- foam rubber layer elastically compressible to 50% of original thickness
- dynamic friction coefficient of the foam material on vinyl media $\mu_k$=0.6
- angle of contact of the wiping roller with the media: 110°
- back tension of the medium: 30 N/m
- speed of rotation of the wiping roller: minimum 30 rpm Examples in the present disclosure can be provided as methods, systems or machine-readable instructions, such as any combination of software, hardware or the like. Such machine-readable instructions may be included on a machine-readable storage medium (including but is not limited to disc storage, CD-ROM, optical storage, etc.) having machine-readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine-readable instructions.

The machine-readable instructions may, for example, be executed by a general purpose computer, a special purpose computer, an embedded processor or processors of other programmable data processing devices to realize the functions described in the description and diagrams. In particular, a processor or processing apparatus may execute the machine-readable instructions. Thus functional modules of the apparatus and devices may be implemented by a processor executing machine-readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine-readable instructions may also be stored in a machine-readable storage that can guide the computer or other programmable data processing devices to operate in a specific mode.

Such machine-readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and many various design implementations are possible without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

Although a number of particular implementations and examples have been disclosed herein, further variants and modifications of the disclosed devices and methods are possible. For example, not all the features disclosed herein are included in all the implementations, and implementations comprising other combinations of the features described are also possible.

The invention claimed is:

1. A non-transitory machine-readable medium encoded with instructions executable by a processor and comprising instructions to:

control a print apparatus to print a test pattern on a test region of a print medium;

receive test data relating to the test pattern printed on the print medium from a sensor;

analyse the test data with reference to baseline data to determine if the test pattern satisfies a print quality criterion;

output an instruction to operate the print apparatus in a first mode, in which a pre-printing treatment is not applied to the print medium, in response to determining that the test pattern satisfies the print quality criterion, the pre-printing treatment comprising wiping a printing surface of the print medium with a wiper element; and output an instruction to operate the print apparatus in a second mode, in which the pre-printing treatment is applied to the print medium, in response to determining that the test pattern satisfies the print quality criterion.

2. A non-transitory machine-readable medium according to claim 1, further comprising instructions to:

control the print apparatus to apply a pre-printing heat treatment to a baseline region of the print medium and subsequently print a baseline pattern on the baseline region; and receive the baseline data relating to the baseline pattern printed on the print medium from the sensor.

3. A non-transitory machine-readable medium according to claim 1, further comprising instructions to retrieve the baseline data from a database.

4. A non-transitory machine-readable medium according to claim 1, further comprising instructions to:

receive print medium data relating to a type of print medium on which the test region is printed; and retrieve the baseline data from a database correlated by print medium type, based on the print medium data.

5. A non-transitory machine-readable medium according to claim 1, wherein the print quality criterion defines a maximum color difference threshold between a portion of the test pattern and a baseline color; and wherein the maximum color difference threshold is between 1ΔE and 6ΔE according to the CIE2000 standard.

6. A non-transitory machine-readable medium according to claim 1, wherein outputting an instruction to operate the print apparatus in the second mode comprises generating an alert for a user to configure the print apparatus in the second mode.

7. A non-transitory machine-readable medium according to claim 1, wherein outputting an instruction to operate the print apparatus in the second mode causes an actuator of the print apparatus to move the wiper element from a disengaged configuration to an engaged configuration in which it is to wipe a print medium.

8. Print apparatus comprising:

a print head to print on a print medium;

a sensor to monitor a printed region of the print medium;

a controller to:

cause the print head to print a test pattern on a test region of a print medium;

receive test data from the sensor relating to the test pattern printed on the print medium;

analyse the test data with reference to baseline data to determine if the test pattern satisfies a print quality criterion;

output an instruction to operate the print apparatus in a first mode, in which a pre-printing treatment is not applied to the print medium, in response to determining that the test pattern satisfies the print quality criterion, the pre-printing treatment comprising wiping a printing surface of the print medium with a wiper element; and output an instruction to operate the print apparatus in a second mode, in which the pre-printing treatment is applied to the print medium, in response to determining that the test pattern satisfies the print quality criterion.

9. Print apparatus according to claim 8, wherein the sensor comprises a spectrophotometer.

10. Print apparatus according to claim 8, wherein the sensor comprises an optical sensor.

11. Print apparatus according to claim 8, further comprising a selectively engageable wiper element to wipe the printing surface of the print medium.

12. A method comprising:

printing a test pattern on a print medium using a print apparatus operating in a first mode in which a pre-printing treatment is not applied to the print medium;

generating test data relating to the test pattern printed on the print medium using a sensor, the sensor monitoring a printed region of the print medium;

analysing the test data with reference to baseline data to determine if the test pattern satisfies a print quality criterion;

operating the print apparatus in a second mode in which the pre-printing treatment is applied to the print medium in response to determining that the test pattern does not satisfy the print quality criterion;

wherein the pre-printing treatment comprises wiping a printing surface of the print medium with a wiper element.

13. A method according to claim 12, wherein the print medium comprises PVC.

14. A method according to claim 12, further comprising: installing the wiper element in the print apparatus in response to determining that the test pattern does not satisfy the print quality criterion.

15. A method according to claim 12, further comprising: causing an actuator of the print apparatus to move the wiper element from a disengaged configuration to an engaged configuration in which it is to wipe a print medium.

* * * * *